US005289927A

United States Patent [19]

Emery

[11] Patent Number: 5,289,927

[45] Date of Patent: Mar. 1, 1994

[54] RELEASABLY MOUNTABLE CADDY DEVICES

[75] Inventor: William W. Emery, Berkeley Heights, N.J.

[73] Assignee: Better Sleep Manufacturing Co., Berkeley Heights, N.J.

[21] Appl. No.: 681,153

[22] Filed: Apr. 5, 1991

Related U.S. Application Data

[63] Continuation-in-part of Ser. No. 388,236, Aug. 1, 1989, Pat. No. 5,014,860.

[51] Int. Cl.[5] ..... A47F 5/00

[52] U.S. Cl. ..... 211/106; 211/87; D6/525; 248/206.3

[58] Field of Search ..... 211/106, 88, 87, 119, 211/105.1; 248/205.5, 206.3, 206.4; D6/525, 537, 540

[56] References Cited

U.S. PATENT DOCUMENTS

| | | | |
|---|---|---|---|
| D. 194,307 | 1/1963 | Raphael | D6/525 |
| D. 195,297 | 5/1963 | Raphael | D6/525 |
| D. 251,522 | 4/1979 | Chapman | D6/525 |
| 1,325,143 | 2/1919 | Conterio | 248/206.4 X |
| 1,483,640 | 2/1924 | Manning | 248/206.3 |
| 2,230,037 | 1/1941 | Hoeflich | 211/106 X |
| 2,672,988 | 3/1954 | Johnson | 211/106 X |
| 3,789,962 | 2/1974 | Stroh | 211/119 |
| 4,708,310 | 11/1987 | Smith | 211/90 X |
| 5,069,350 | 12/1991 | Wolff et al. | 211/119 X |

*Primary Examiner*—Robert W. Gibson, Jr.
*Attorney, Agent, or Firm*—Hopgood, Calimafde, Kalil, Blaustein & Judlowe

[57] ABSTRACT

This invention is directed to caddy devices mountable on non-porous surfaces by means of suction cups which are easily repositioned in all directions. The devices are characterized by streamlined frame portions, support elements for slidably receiving suction cups and recessed covers that conceal the mounting apparatus from plain view. The disclosed configurations insure close attachment of the caddy device to the mounting surface. Stabilizing structures are also provided for the caddy frame. In various illustrated embodiments, the caddy can be a towel ring, toilet tissue holder, storage rack or multipurpose organizer.

22 Claims, 7 Drawing Sheets

RELEASABLY MOUNTABLE CADDY DEVICES

This is a continuation-in-part of copending application(s) Ser. No. 388,236 filed on Aug. 1, 1989, now U.S. Pat. No. 5,014,860.

FIELD OF INVENTION

The present invention relates to caddy devices, and more particularly, to caddy devices which can be releasably attached to mounting surfaces for ease of installation and repositioning.

BACKGROUND OF THE INVENTION

Shower caddies have evolved over the past decade with increased popularity based on convenience and design choice. Most art-recognized devices are suspended from the shower arm or pipe which extends from the wall of a bath area. Representative examples are described in Stroh U.S. Pat. No. 3,789,966. Each shower caddy of this type utilizes a mounting technique that restricts the caddy to a single location defined by the shower head. The overall design is not practical for many applications where faucets and soap dishes present obstacles to efficient installation. Uneven loads cause some caddies of this general design to swing from the shower head pivot. Other configurations require aesthetically displeasing mounting apparatus which detract from the overall appearance of the surrounding area.

Certain prior art corner caddies are held in place with double-faced pressure sensitive tape. An example of this limited design is illustrated by Smith U.S. Pat. No. 4,708,310. The caddy device is necessarily mounted in a corner of the bath area. Conventional adhesives make the caddy difficult to reposition or remove for cleaning or replacement. Many adhesives fail in a humid environment causing the "loaded" caddy to fall off the mounting surface.

Several known devices have used suction cups to prevent free movement of a suspended caddy. The prior art designs generally provide for suction cups mounted on a caddy post extending in a direction perpendicular to the suction cup face. These expedients offer little strength under normal loading conditions and are insufficient by themselves to mount a caddy with any degree of reliability.

Modern families have many bathing accessories that are used in the shower and tub area. Commercial advertising encourages each family member to purchase his/her own shampoo, hair conditioner, complexion soaps, body lotions and skin softeners. Additional bath items include brushes, loofas, sponges, razors, shaving cream and the like. Many other accessories are used in non-bath areas, such as kitchens, pantries, laundry rooms, workshops and the like. This has created a practical and commercial need for larger, more versatile caddies which are conveniently and securely mounted on a non-porous surface. A series of caddy devices is sometimes necessary to accommodate several family members and alternative end-use applications.

The various caddy devices should overcome the shortcomings and drawbacks of prior art designs, while accommodating the requirements of modern lifestyles. Accordingly, it is an object of the present invention to provide a variety of caddy devices which are capable of convenient and versatile installation.

Another object of the present invention is to provide caddy organizers which are easily removed and repositioned.

Yet another object of the present invention is to provide caddy devices with a streamlined profile and improved mounting system which facilitates close attachment to a mounting surface.

An additional object of the present invention is to provide a series of "hang-anywhere" caddy devices which are suitable for areas other than the bath.

A further object of the present invention is to provide an aesthetic and/or functional apparatus for mounting caddy devices on a non-porous surface.

These and other objects will be apparent from this disclosure.

SUMMARY OF THE INVENTION

In accordance with the present invention, a variety of caddy devices can be independently and releasably mounted on a wall surface, preferably by suction cups which are easily positioned and repositioned.

In general, the caddy device comprises a frame with at least one planar region disposed substantially parallel to the mounting surface. The frame has a wall attachment side and a caddy side adapted for shelves, galleries, hooks, loops, bars and equivalent storage configurations. Support elements are rearwardly attached to the planar region of the frame. Various support elements may be formed as a continuous bar, lateral projection or other linear configuration. These frame support elements have at least one free end adapted to receive a suction cup. The suction cups are designed for firm, safe, secure adhesion to tile, glass, porcelain, marble or other non-porous surfaces. Each has a pliable lip portion for conventional vacuum attachment and a mounting portion which provides a unique bore located in a plane substantially parallel to the mounting surface. The bore permits slidable engagement between the frame support element and mounting portion of the suction cup. This parallel arrangement virtually eliminates dislocation of the frame support element from the mounting portion bore.

According to the present invention, the frame support elements and suction cup mounting portions are substantially disposed within a planar region of the caddy frame. This coplanar arrangement provides a streamlined profile for the caddy organizer and permits close attachment to the mounting surface. The overall design reduces torque and the tendency for caddy dislocation from the mounting surface.

In certain embodiments cover structures are used to conceal the suction cups and frame support elements from plain view. These concealing structures have a recessed portion disposed in a direction away from the mounting surface to accommodate any portion of the suction cup which may protrude outwardly beyond the substantially planar region of the caddy frame. This feature facilitates closer attachment of caddy frames to wall mounting surfaces as compared to prior art devices. It also provides an aesthetic improvement over known designs.

Various embodiments are provided with stabilization structures which insure that the planar portion of the caddy frame remains substantially parallel to the wall mounting surface. The caddy frame may assume a plurality of shapes to form, by way of illustration, a corner shelf, soap dish or U-shaped storage rack. Additional embodiments are based on changes made to other elements of the caddy structure. For example, frame support elements may be formed as part of a removable, rotatable looped portion which functions as a towel ring or towel rack. These frame support elements can be rotatably connected to the caddy frame as shown by the drawings.

BRIEF DESCRIPTION OF THE DRAWINGS

For a more complete understanding of this invention, reference is made to the following detailed description of the illustrated embodiments in connection with the accompanying drawings.

DETAILED DESCRIPTION OF THE ILLUSTRATED EMBODIMENTS

Figure 1:
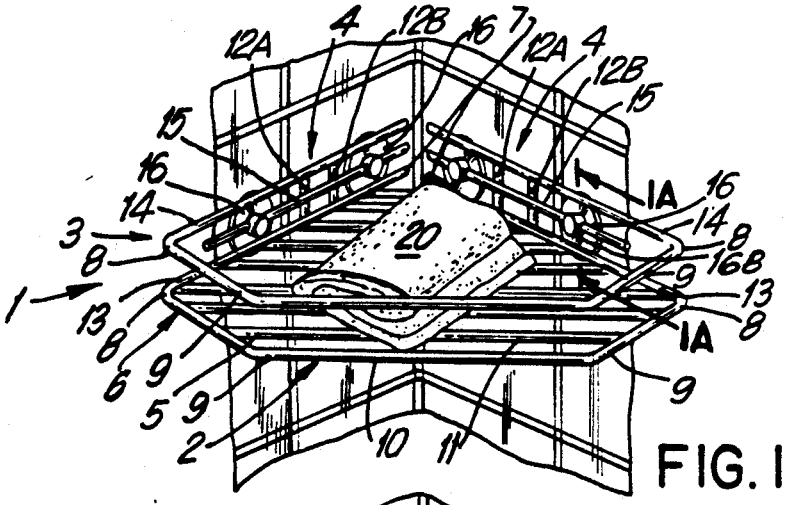
FIG. 1 is a perspective view of an adjustable corner caddy showing a first embodiment of the present invention.

The first embodiment of the present invention will now be described in connection with FIG. 1. Corner caddy 1 comprises corner shelf portion 2, gallery portion 3 disposed above shelf portion 2, and a frame-to-wall mounting assembly generally indicated by reference numeral 4. Corner shelf portion 2 includes shelf member 5 made from wire frame 6 having the general shape of a right triangle. Open ends 7 of wire frame 6 are disposed at 90°, typically adjacent a wall corner. Acute angles 8 and 9 are formed by two bends made in the shelf frame and gallery. Frame element 10 opposite the 90° angle is rectilinear as illustrated, but it may assume any desired shape. Cross members 11 are fastened to wire frame 6 in parallel disposition. In the illustrated embodiment, cross members 11 are oriented in a direction perpendicular to a line bisecting the 90° corner angle. So arranged, an openwork bottom is formed in shelf member 2.

Gallery portion 3 has essentially the same shape and size as shelf frame 6. As shown, shelf portion 5 is fastened to gallery portion 3 by two pair of vertical members 12A and 12B which rigidly join horizontal members 13 and 14 of the shelf frame and gallery. Horizontal support bar 15 is attached to each pair of vertical members 12A and 12B. Support bars 15 are open at each end to receive suction cups 16. Horizontal support bars 15 may function as frame support elements and, taken together, support bars 15 and suction cups 16 comprise the frame-to-wall mounting assembly for this embodiment.

Figure 1A:
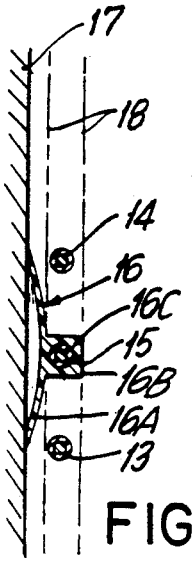
FIG. 1A is a cross-sectional view of the corner caddy, taken along line 1A—1A of FIG. 1, showing the caddy frame closely attached to a mounting surface.

As illustrated more clearly in FIG. 1A, suction cup 16 has wall engagement portion 16A and mounting portion 16B. Mounting portion 16B has a cylindrical bore 16C formed therethrough. Suction cup 16 is positioned horizontally along the free end of frame support element 15, as indicated. This arrangement permits secure, convenient attachment to a mounting surface.

As illustrated in FIG. 1A, suction cup mounting portion 16B may be integrally formed with wall engagement portion 16A. Bore 16C allows for slidable engagement with the free end of frame support element 15, which is preferably disposed substantially parallel to mounting surface 17. This arrangement provides a significant advantage because it eliminates unintended displacement of suction cup 16 caused by loading forces transverse to bore 16C. In this particular embodiment, frame support element 15 and suction cup mounting portion 16B are disposed substantially within the planar region 18 of the caddy frame. As a result, the caddy device is attached in close cooperation with the mounting surface. Load bearing torque is reduced and the caddy is stabilized during end-use application.

Figure 2:
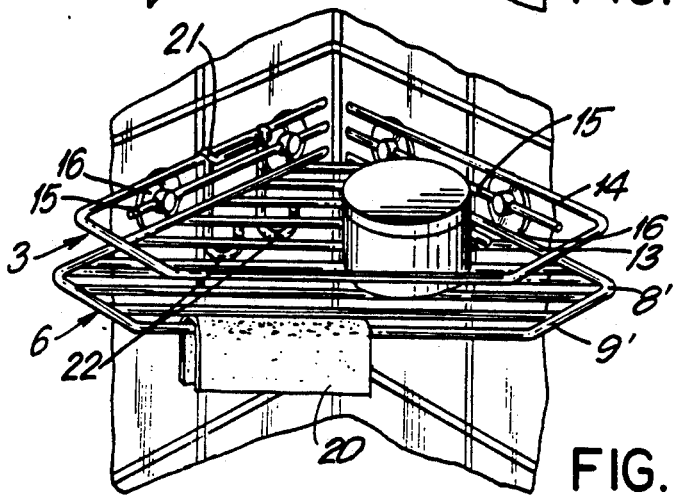
FIG. 2 is a perspective view of a corner caddy, showing a second embodiment having an extended gallery forming a drying rack.

FIG. 2 shows a second embodiment of the corner shelf caddy organizer of the present invention. While this device is similar in many respects to the caddy device shown in FIG. 1, there are some differences. In particular, the gallery frame of this embodiment effectively extends shelf frame 6 by occupying a smaller area than the gallery portion shown in FIG. 1. Extended shelf frame 6 can function as a drying rack to hold illustrative towel 20, as shown in FIG. 2.

The caddy devices of FIGS. 1 and 2 can be marketed together as an organizing system which permits the shelf portions to be positioned at any desired height and spatial distance to accommodate bath articles of various sizes. Also as shown in FIG. 2, a bent wire device 21 releasably attached to gallery frame 9' can provide hooks 22 for various uses. Alternatively, vertical members 12A and 12B may be extended downwardly and hooks, such as 22, may be formed on the extended portions thereof.

Figure 3A:
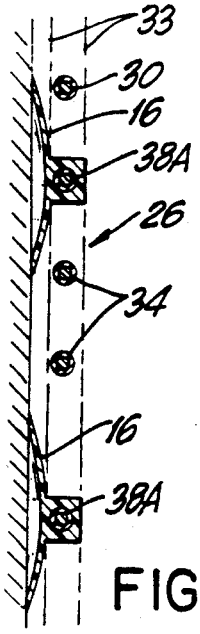
FIG. 3A is a cross-sectional view of the caddy device taken along line 3A—3A of FIG. 3, showing the caddy frame closely attached to a mounting surface.
Figure 3:
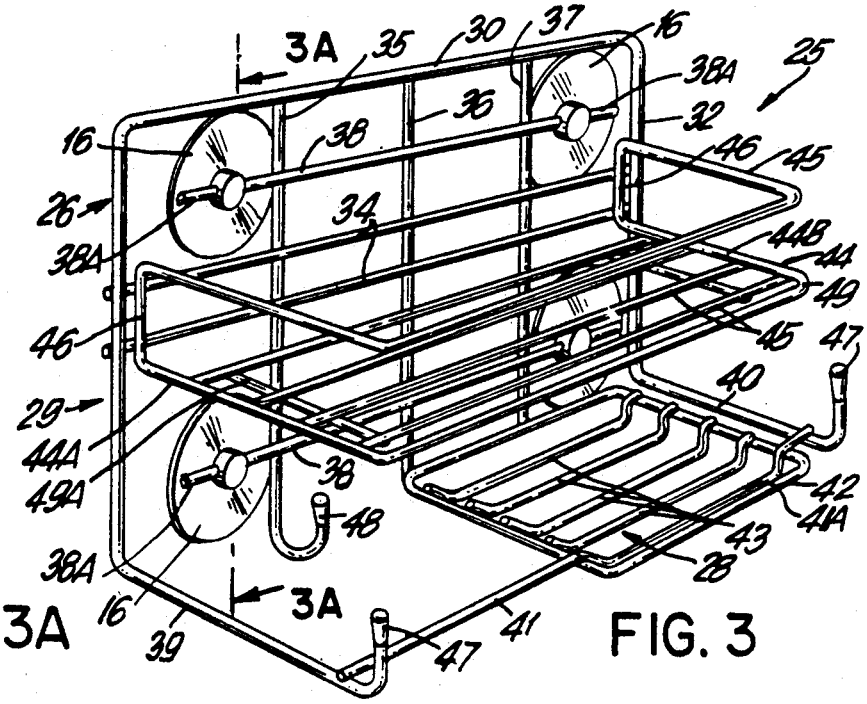
FIG. 3 is a perspective view of a caddy device provided by the present invention, showing a third embodiment having a galleried shelf, soap dish and hooks adaptable for wall mounting.

FIGS. 3 and 3A illustrate a third embodiment of a caddy organizer device constructed in accordance with the present invention. In general, caddy device 25 comprises wall-facing frame portion 26, shelf portion 27, soap dish portion 28, and a frame-to-wall mounting assembly integrated with the wall-facing frame portion. Frame portion 26 includes wire frame 29 having horizontal element 30 from which vertical elements 31 and 3 extend at right angles within planar region 33 of the caddy frame. A pair of spaced-apart horizontal members 34 are attached at each end to mid-portions of frame elements 31 and 32. Three spaced-apart vertical members 35, 36 and 37 are attached to horizontal frame element 30 and horizontal member 34, as shown. Substantially horizontal members 34 are parallel to horizontal frame element 30; and vertical members 35, 36 and 37 are substantially parallel to vertical elements 31 and 32.

Two horizontal frame support bars 38 are adapted with free ends 38A. They are fastened to vertical members 35, 36 and 37, and disposed substantially parallel to the plane of the wall. Free ends 38A slidably receive suction cups 16 through the bore formed in the mounting portions of the respective cups. As shown in FIG. 3, suction cups 16 are mounted in pairs one above the other, rather than along a horizontal line as shown in the devices of FIGS. 1 and 2.

Downwardly extending frame elements 31 and 32 extend outwardly to form support arms 39 and 40 which hold rack member portions 41 and 41A. Hooks 47 may be provided at the end of support arms 39 and 40. Hook 48 may be similarly disposed at the bottom of vertical member 35. Soap dish 28 is attached to the end portion of vertical members 36 and 37. Soap dish 28 is formed by frame portion 42 and parallel extending wires 43 which are slightly depressed below the plane of frame portion 42 to hold the soap.

Shelf portion 27 includes generally rectangular frame 44 and gallery 45 supported by transversely extending portions 46. A plurality of spaced-apart shelf elements 45 are attached between end portions 44A and 44B to form an open-work support structure as shown. As shown in FIG. 3, shelf elements 49A and 49B are attached to the underside of shelf elements 45 and disposed parallel to frame end portions 44A and 44B. Shelf portion 27 is attached to horizontal members 34 by way of transverse portion 46.

The caddy organizer of FIG. 3 is adapted for mounting on any non-porous surface and, as in the embodiments shown in FIGS. 1 and 2, suction cups 16 can be adjustably located along the free ends of frame support bars 38 to suit the convenience of the user. Multiple items can be easily stored in shelf portion 27 of the caddy.

Figure 4:
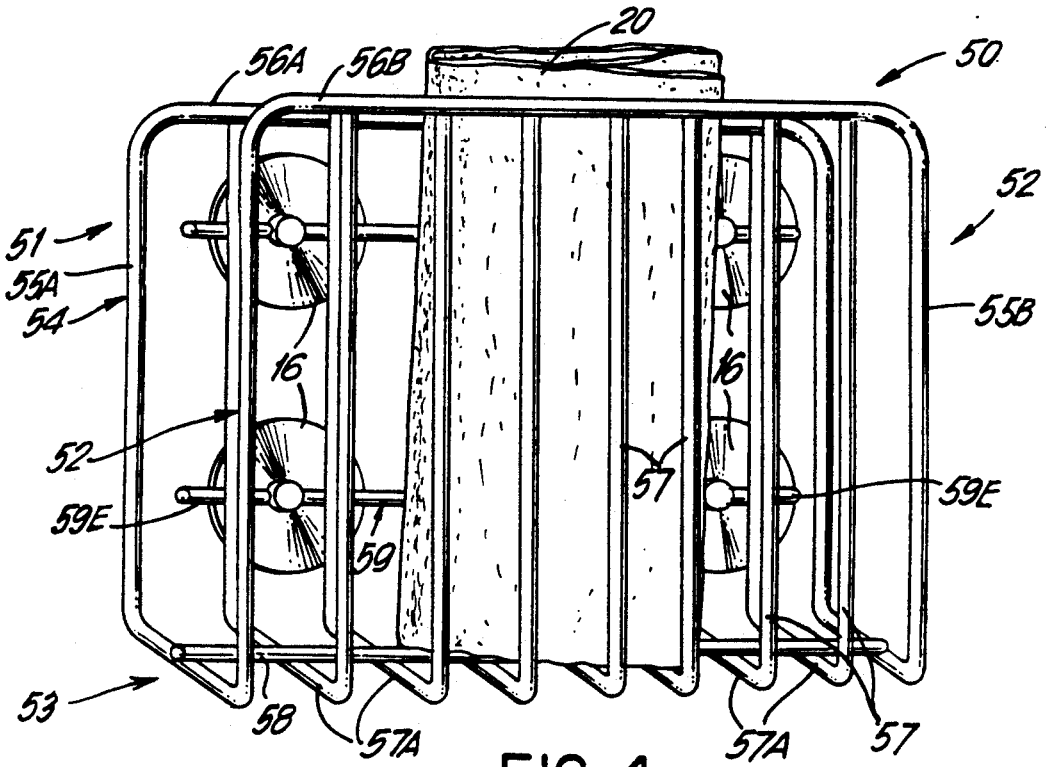
FIG. 4 is a perspective view of a caddy device provided by the present invention, showing a fourth embodiment having a U-shaped, storage rack.
Figure 5:
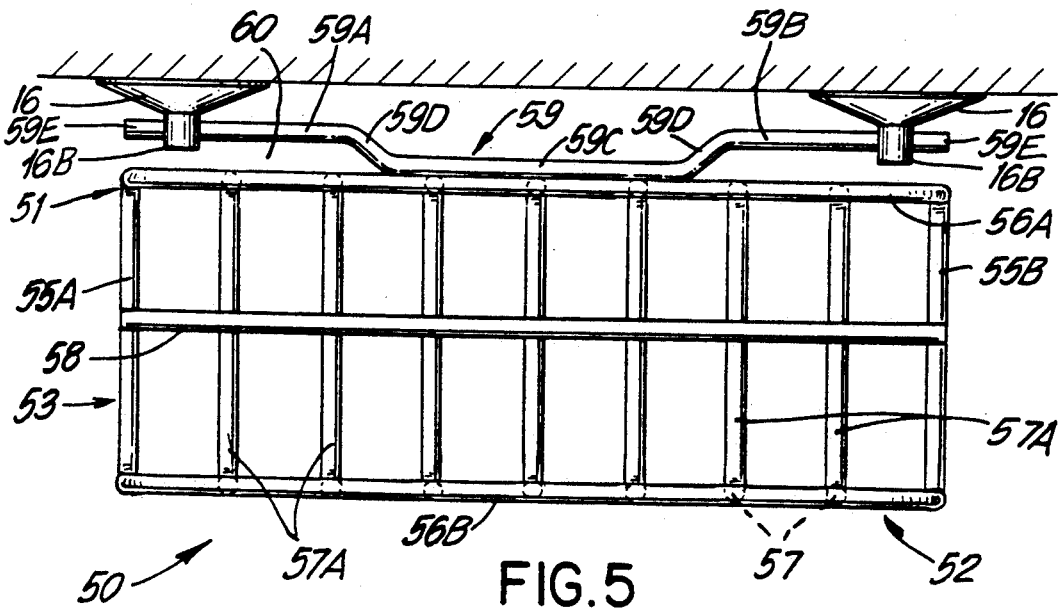
FIG. 5 is a plan view of the FIG. 4 caddy device.

FIGS. 4 and 5 illustrates a fourth embodiment of the present invention. U-shaped caddy device 50 comprises wall-facing frame portion 51, front planar portion 52, shelf portion 53 connecting opposing portions 51 and 52 and a frame-to-wall mounting assembly. Frame portions 51 and 52 form a storage assembly having a generally U-shaped cross-sectional dimension. A frame assembly is formed by wire frame 54 having two spaced-apart, U-shaped end portions 55A and 55B as shown. Wire frame 54 also includes horizontal bar portions 56A and 56B which continuously extend from respective ends of U-shaped end portions 55A and 55B to form a defined volume.

A plurality of U-shaped members 57 are attached to horizontal members 56A and 56B. They are parallel to U-shaped portions 55A and 55B, and to each other. To stabilize the frame assembly and improve its rigidity, rectilinear member 58 is attached to the bottom portion of U-shaped members 57 and to end U-shaped portions 55A and 55B, as shown. Shelf portion 53, formed by bottom portions 57A of U-shaped members 57, is useful for holding articles such as magazines, books, hair dryers, towels, toys, sponges, loofas, brushes, etc. at a convenient height and location.

As illustrated in FIG. 5, the frame-to-wall mounting assembly includes suction cup support bar 59 having offset bar portions 59A and 59B, joined by an intermediate portion 59C through transitional portions 59D. In the illustrated embodiment, suction cup support bar 59 is connected to three adjacent U-shaped members 57. Offset portions of the support element have free ends 59E which are substantially parallel to the wall surface. Since offset portions 59A and 59B are disposed away from U-shaped members 57, clearance 60 is provided for sliding mounting portion 16B of suction cup 16 along the free ends of support bar 59.

Figure 6:
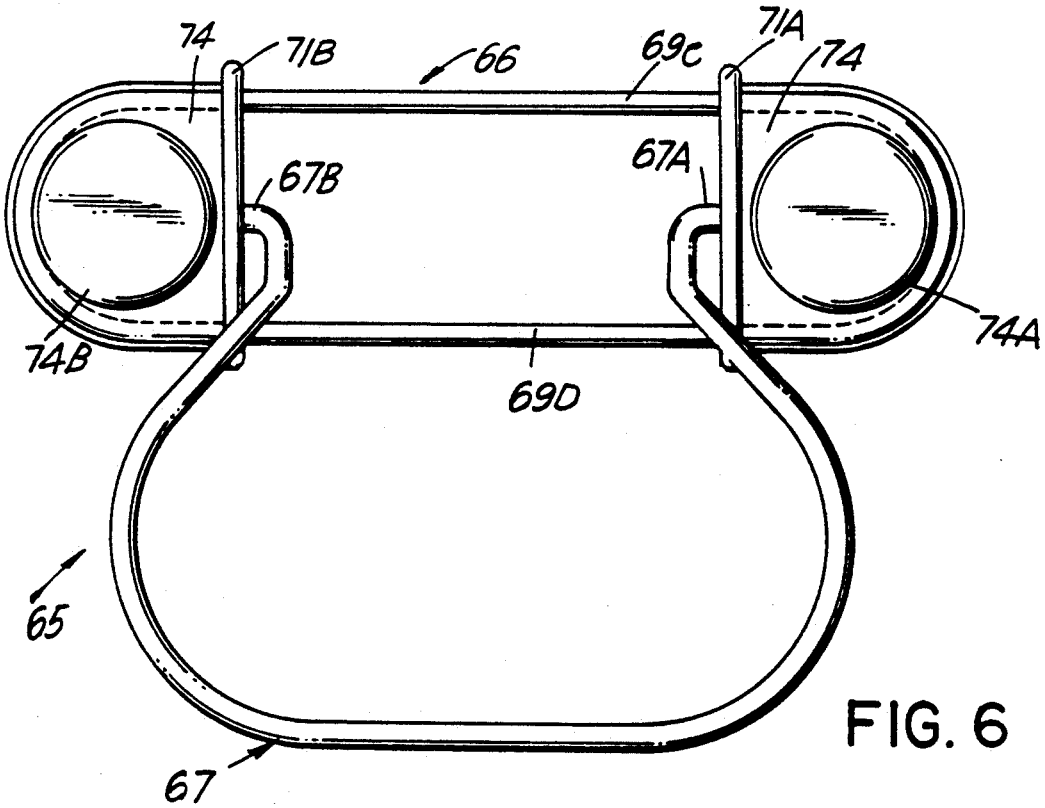
FIG. 6 is an elevated front view of a caddy device showing a fifth embodiment of the present invention.
Figure 6A:
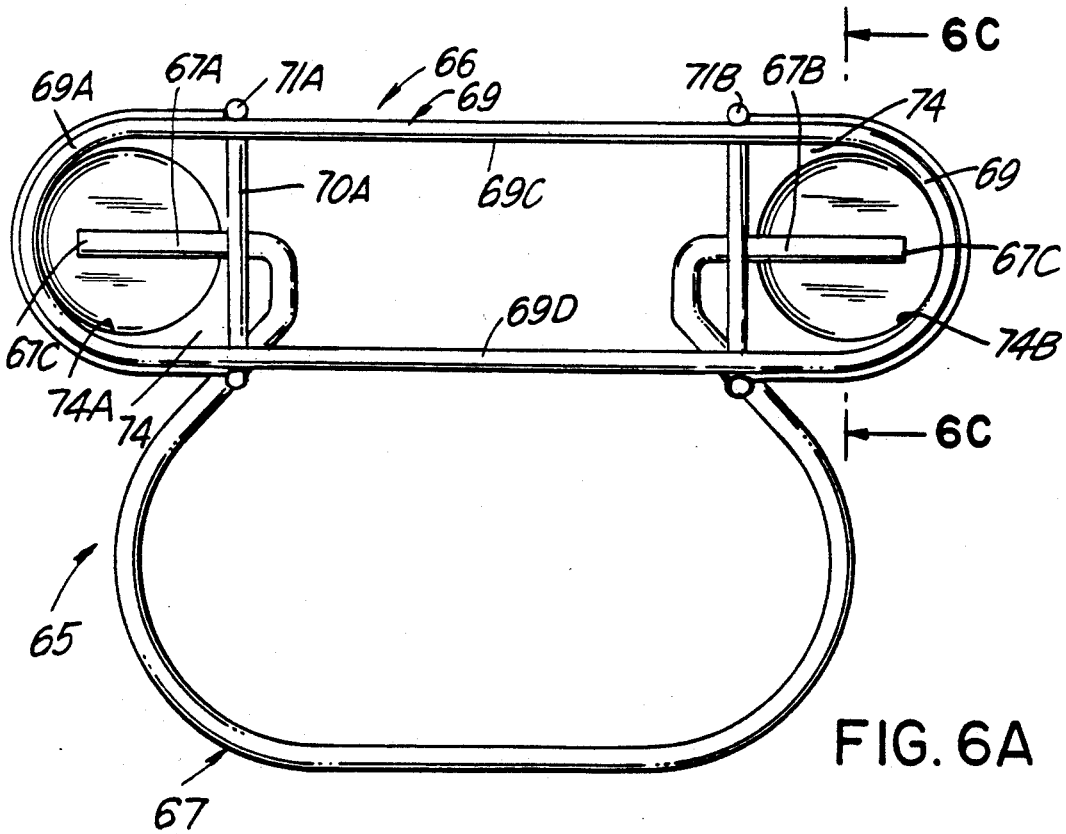
FIG. 6A is an elevated rear view of the FIG. 6A caddy device.
Figure 6B:
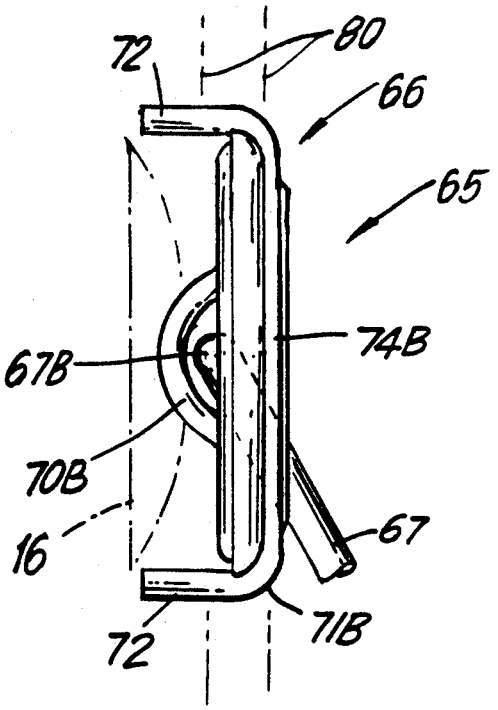
FIG. 6B is an elevated side view of the caddy device shown in FIGS. 6 and 6A.
Figure 6C:
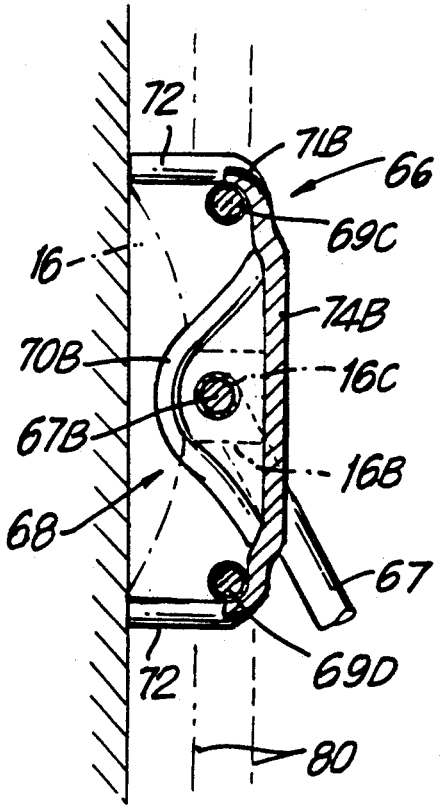
FIG. 6C is a cross-sectional view of the caddy device taken along line 6C—6C of FIG. 6A.

In FIGS. 6, 6A, 6B and 6C, a fifth embodiment of the present invention is shown in the form of a towel ring caddy. Caddy device 65 comprises a wall-facing frame portion, towel ring 67 and frame-to-wall mounting assembly 68. Frame portion 66 includes wire frame 69 having semi-circular portions 69A and 69B disposed between linear members 69C and 69D, which extend along the upper and lower frame portions, respectively. As illustrated in FIGS. 6B and 6C, the semi-circular and linear portions of the frame are disposed substantially within planar region 80.

As shown most clearly in FIG. 6A, towel ring 67 comprises a loop portion which terminates in a pair of support elements 67A and 67B. Support elements 67A and 67B have free ends 67C which are disposed substantially along a common axis. In order to rotatably attach support elements 67A and 67B to frame portion 66, mounting loop portions 70A and 70B are attached to the rear side of vertical members 71A and 71B, each of which has stabilizing portions 72, as illustrated in FIG. 6C. Support elements 67A and 67B are permitted to pass freely through the loop structure (i.e., eyelet) formed between mounting loop portions 70A and 70B, and vertical members 71A and 71B.

As shown in FIG. 6C, the center of mounting loop structures 70A and 70B are disposed substantially within planar region 80 of frame portion 66. When placed within respective mounting loop structures, support elements 67A and 67B are permitted to rotate over an angular displacement sufficient to permit conventional use. At the same time, support elements 67A and 67B are capable of receiving suction cups 16 by sliding bore 16C over and along free end 67C. Taken together, support elements 67A and 67B and suction cups 16 comprise the frame-to-wall mounting assembly for this embodiment.

As illustrated in FIG. 6C, when suction cups 16 are slidably mounted over free ends 67C of support elements 67A and 67B, each suction cup mounting portion is disposed substantially within the planar region of the frame portion. This condition has several significant advantages. It permits the frame portion to attach in close proximity to the mounting surface. It also permits coplanar arrangement of the suction cup lip portions and stabilizing portions 72 of vertical members 71A and 71B. When the towel ring caddy is mounted, stabilizing portions 72 abut the wall surface as shown. This configuration counteracts any tendency of the caddy to rotate about support elements 67A and 67B when towel ring loop 67 is rotated upwardly or downwardly during end use application.

In order to conceal suction cups 16 and free ends 67C of support elements 67A and 67B, cover portions 74 are provided as shown in FIGS. 6 and 6A. Each cover 74 has recessed portion 74A and lip portion 74B extending about the semi-circular perimeter of the frame. Cover 74 can be attached to the frame by welding or friction fit engagement. As illustrated more clearly in FIGS. 6B and 6C, recessed portion 74A protrudes outwardly and accommodates suction cup mounting portions 16B which may extend away from the wall beyond planar region 80 of the frame. Each cover contributes to the structural integrity of the frame and provides an attractive appearance to the overall towel ring caddy device.

Figures 7, 7A:
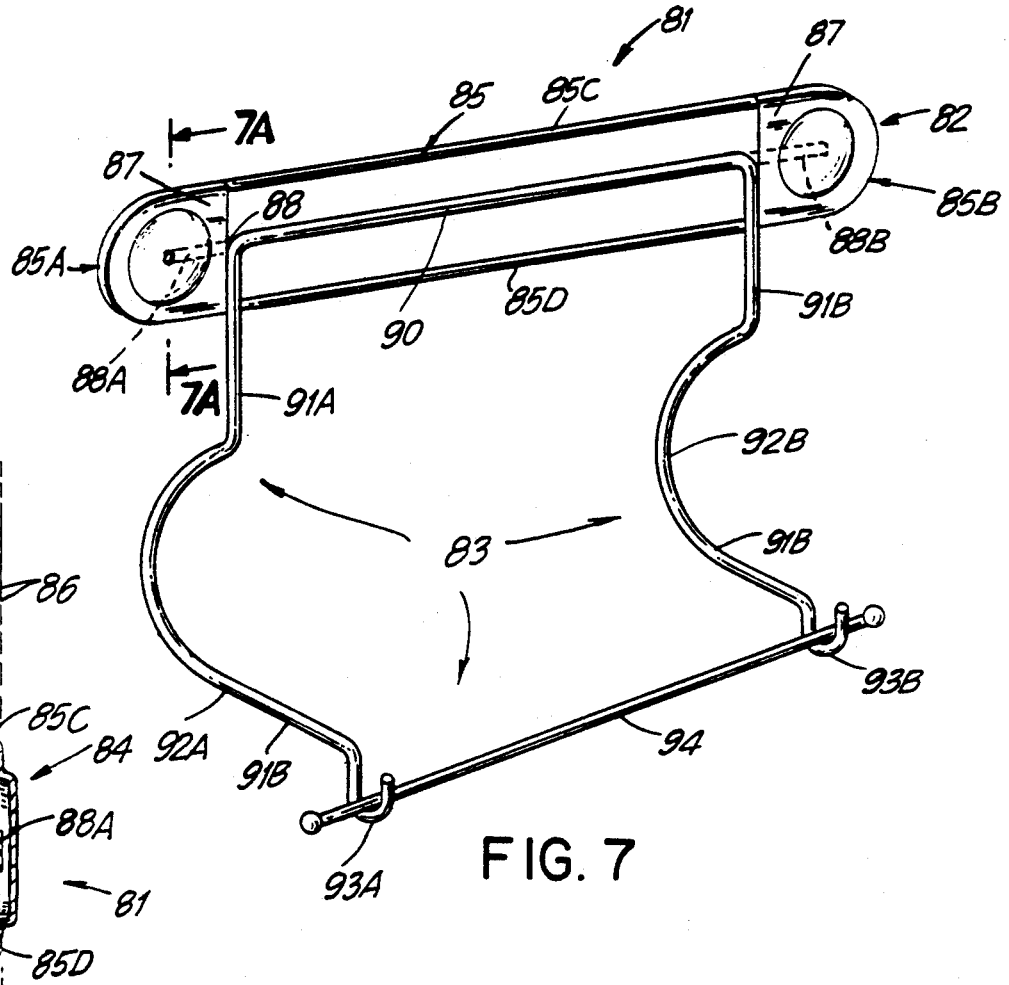
FIG. 7 is a perspective view of a toilet tissue caddy showing a sixth embodiment of the present invention.
FIG. 7A is an elevated cross-sectional view of the toilet tissue cady taken along line 7A—7A of FIG. 7.

In FIG. 7, a sixth embodiment of the present invention is shown in the form of a toilet tissue caddy. Toilet tissue caddy 81 comprises wall-facing frame portion 82, toilet tissue support means 83 and frame-to-wall mounting assembly 84. Frame portion 82 comprises frame 85 having semi-circular portions 85A and 85B which are connected by substantially parallel linear portions 85C and 85D. All frame portions are substantially disposed in planar region 86, as shown in FIG. 7A. Covers 87 are disposed over the semi-circular end portions of the frame. Linear support element 88 is rearwardly attached to cover 87 at each end and disposed substantially within the planar region of the frame. It is also substantially parallel to linear portions 85C and 85D of the frame.

In this configuration, free ends 88A and 88B are adapted to receive suction cup 16 as previously described. The mounting portion of each suction cup will be disposed substantially within the planar region of the frame, as shown in FIG. 7. Any portion of suction cup 16 extending beyond planar region 86 is accommodated by the recess portion of cover 87 which conceals the suction cup from the plain view as shown in FIG. 7. Taken together, free ends 88A and 88B of support element 88 and suction cups 16 comprise the frame-to-wall mounting assembly for this embodiment.

As illustrated in FIG. 7, toilet tissue support means 83 is a structural arrangement having two components. The first component includes linear portion 90 which is fixedly attached to linear support element 88 by way of a front opening in the frame. Linear portion 90 has a pair of spaced apart arm-like elements 91A and 91B which extend outwardly over portions 92A and 92B to provide support hooks 93A and 93B. The second component is a separate, linear member 94 which can be horizontally supported within hooks 93A and 93B, as shown. When the caddy is mounted to a surface by suction cups 16, rearwardly extending bends formed in portions 92A and 92B will engage the wall surface. This stabilizes the caddy so that wall-facing frame portion 82 is maintained substantially parallel to the mounting surface during installation and use.

Figure 8:
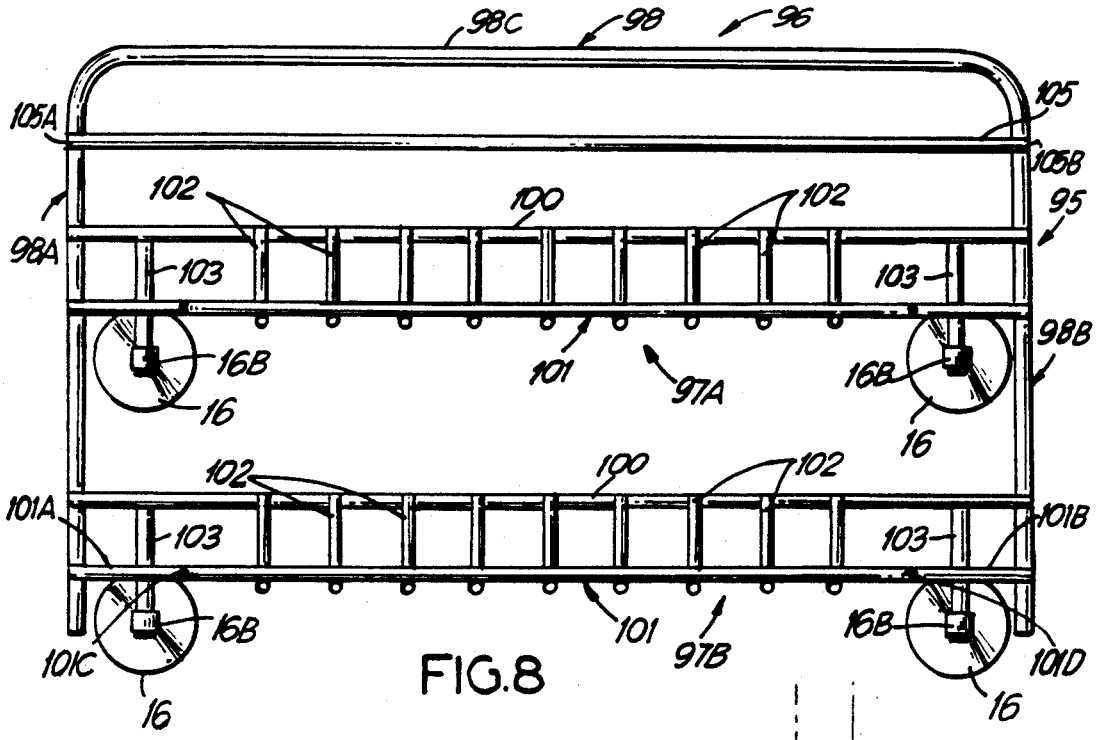
FIG. 8 is an elevated front view of a general purpose caddy device showing a seventh embodiment of the present invention.
Figure 8A:
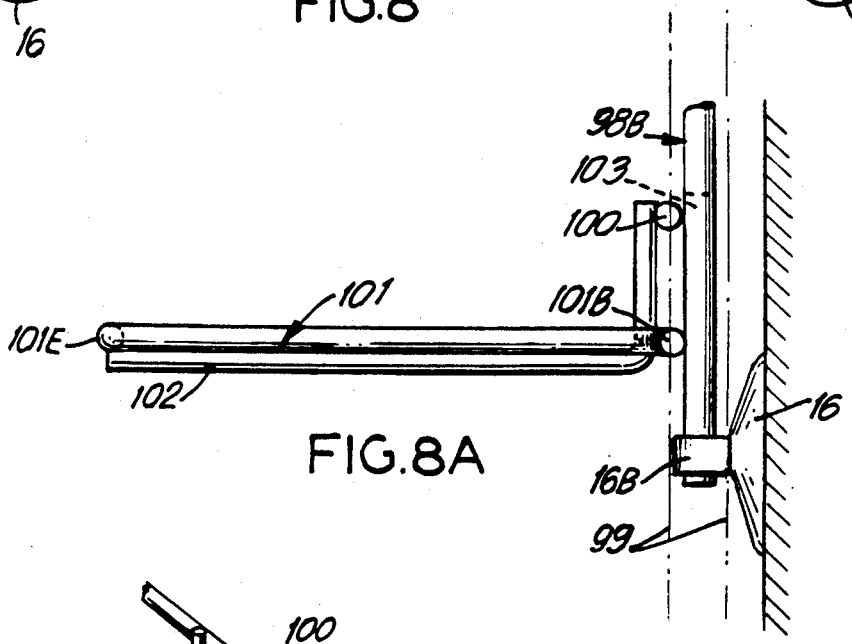
FIG. 8A is a partially fragmented, side view of the FIG. 8 caddy device.
Figure 8B:
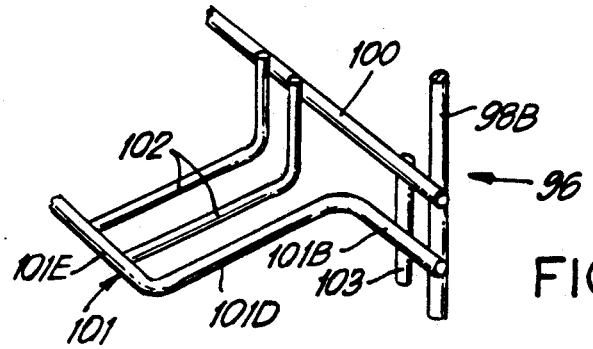
FIG. 8B is a partially fragmented, perspective view of the FIG. 8 caddy device, showing the various components used to form the shelf assembly of the caddy device.

A seventh embodiment of the present invention is shown in FIGS. 8, 8A and 8B. The illustrated caddy device is adapted for storing and organizing a number of items having diverse shapes and sizes. Caddy device 95 comprises wall-facing frame portion 96, shelf assemblies 97A and 97B and a frame-to-wall mounting assembly. Frame portion 96 is formed by wire frame 98 having a pair of spaced-apart vertical members 98A and 98B which are connected at their top end to horizontal member 98C. Together these vertical and horizontal members define a generally rectangular expanse. They are disposed substantially within planar region 99, illustrated in FIG. 8A.

As illustrated in FIGS. 8, 8A and 8B, shelf portions 97A and 97B comprise a linear member 100, shelf-frame defining member 101, and several L-shaped shelf elements 102. Shelf-frame defining member 101 includes portions 101A and 101B which are substantially parallel to top horizontal member 98C. Member 101 has orthogonally extending portions 101C and 101D which are joined together by linear element 101E. Linear member 100 is attached to vertical members 98A and 98B, and is substantially parallel with horizontal member 98C. Shelf-frame defining member 101 is attached to vertical members 98A and 98B so that orthogonally extending portions 101C and 101D extend away from the planar region of the frame at approximate right angles. Each L-shaped shelf element 102 is attached at one end to linear member 100 and, at the other end, to linear shelf-element 101E, as shown in FIG. 8B. L-shaped shelf elements 102 are attached to member 100 and element 101E to form a shelf structure.

In order to provide additional support and facilitate mounting of the caddy, bar support element 103 is attached between an end portion of linear member 100 and to a portion of shelf-frame defining member 101B, so that support element 103 is substantially parallel to vertical members 98A and 98B. As shown, support element 103 is installed at each end of the shelf portions. In such an arrangement, each support element 103 is disposed substantially within the planar region of the caddy frame, as illustrated in FIG. 8A. Suction cup 16 is slidably received by and supported on a free end portion of support element 103. When installed, suction cup mounting portion 16B will be disposed substantially within the planar region of the caddy frame. Once again, this configuration permits close attachment of the caddy frame to the mounting surface. Taken together, support elements 103 and suction cups 16 comprise the frame-to-wall mounting assembly for this embodiment.

To insure safekeeping and eliminate faults, gallery 105 is installed above top shelf portion 97A in a parallel plane. As illustrated in FIG. 8, gallery 105 has a geometry similar to shelf-frame defining member 101, described above. End portions 105A and 105B of gallery frame 105 are attached to vertical members 98A and 98B at a preselected height above top shelf portion 97A.

Figure 9:
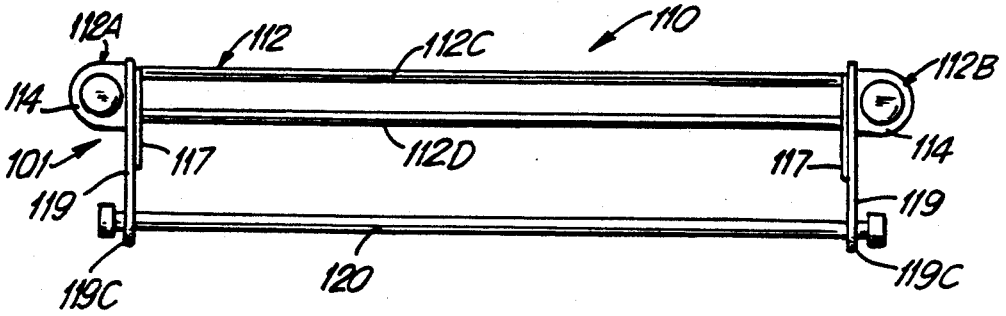
FIG. 9 is an elevated front view of a towel-rack caddy showing an eighth embodiment of the present invention.
Figure 9A:
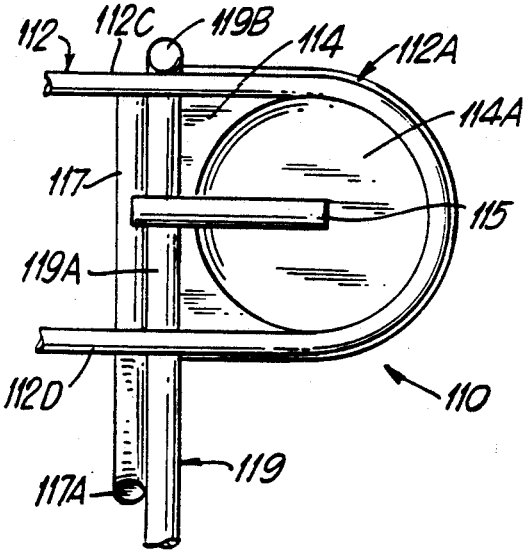
FIG. 9A is a partially fragmented, rear view of the FIG. 9 caddy device, showing the frame support element and recessed cover with the suction cup attachment device removed from the free end of the frame support element.
Figure 9B:
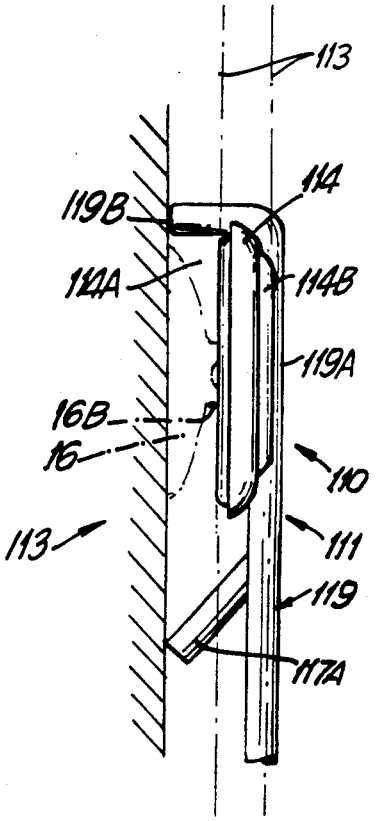
FIG. 9B is a partially fragmented, side view of the FIG. 9 caddy device showing the suction cup attachment device mounted to a wall surface, and having frame stabilizing structures.

In FIGS. 9, 9A and 9B, an eighth embodiment is shown in the form of a towel-rack caddy. In general, towel-rack caddy 110 comprises wall-facing frame portion 111, towel-rack assembly 112 and a frame-to-wall mounting assembly. Frame portion 111 comprises frame 112 having semi-circular end portions 112A and 112B, which are connected by substantially parallel upper and lower horizontal portions 112C and 112D. All portions of the frame are disposed within planar region 113 generally illustrated by FIG. 9B. Semi-circular end portions 112A and 112B are provided with covers 114 of the type previously described and shown in FIGS. 6 and 7. Each cover has recess portion 114A which extends outwardly and beyond planar region 113, as generally illustrated in FIG. 9B.

Referring to FIG. 9A, bar support element 115 is attached to the underside of cover 114, so that the free end of support element 115 is disposed below recess portion 114A. This arrangement is provided at both ends of the caddy frame so that suction cup 16 can be engaged by sliding the mounting portion bore over and along the free end of support element 115. As previously described, suction cup mounting portion 16B will be disposed substantially within the planar region of the caddy frame. Any outward extension of suction cup 16 beyond planar region 113 is accommodated by cover recess portion 114A as shown in FIG. 9B. Taken together, support elements 115 and suction cups 16 comprise the frame-to-wall mounting assembly for this embodiment.

In order to counteract downwardly directed rotational forces (i.e., torque), stabilizing bar 117 is mounted at each end of the caddy frame, on the outer side. Bar 117 is orthogonal with respect to upper and lower linear portions 112C and 112D. Contacting portion 117A engages the mounting surface and stabilizes the caddy frame.

As illustrated in FIGS. 9A and 9B, towel rack assembly 112 comprises outwardly extending support arm members 119, each having linear portion 119A which is attached to the outside surface of cover 114, and which is parallel to stabilizing bar 117. At the upper end of linear portion 119A, an orthogonally directed stabilizing portion 119B extends toward the mounting surface. Stabilizing portion 119B cooperates with stabilizing bar 117 to locate the frame in a plane substantially parallel to the mounting surface.

Extending from the other end of linear portion 119A is upwardly turned portion 119C which terminates in a substantially circular eyelet. The ends of towel support rod 120 extend through the circular eyelets. Support rod 120 can be equipped with caps to secure its position during end-use application.

The caddy devices of the present invention can be made by known techniques including, for example, welded steel wire covered with polyethylene coating. Some components can be produced as molded plastic parts. The caddy devices offer a practical advantage because they are adapted to hold a variety of articles within convenient reach. They can be removed and replaced, in strong contrast to adhesively fastened, fixed position caddy devices.

The illustrated embodiments have proven to be useful in many applications for the caddy art. Further modifications based on the disclosure will occur to persons skilled in the art. These modifications are within the scope and spirit of the present invention as defined by the following claims.

What is claimed is:

1. A caddy device for releasable and repositionable attachment to a mounting surface, which comprises:

a frame having a substantially planar region, an attachment side and a caddy side;

caddy means attached to said frame for supporting an object;

a support element having a free end and being attached to said frame;

attachment means for releasable engagement with said mounting surface, including a mounting portion adapted to slidably receive said free end of said support element; and concealing means to substantially cover said attachment means and said support element from plain view.

2. The caddy defined by claim 1, wherein said caddy means is attached rotatably to said frame.

3. The caddy defined by claim 2, wherein said caddy means is a unitary piece including a looped portion having two ends, each end being integrally connected with one said support element.

4. The caddy defined by claim 1, wherein said support element is a bar disposed in said substantially planar region.

5. The caddy defined by claim 4, wherein said bar is disposed horizontally.

6. The caddy defined by claim 4, wherein said bar is disposed vertically.

7. The caddy defined by claim 1, wherein said caddy means includes an integral extension of said planar region of said frame.

8. The caddy defined by claim 1, wherein said concealing means includes a recessed portion for accommodating the mounting portion of said attachment means.

9. The caddy defined by claim 1, wherein said attachment means includes a suction cup having a wall engagement portion and said mounting portion includes a bore disposed in a plane substantially parallel to the plane of said lip portion.

10. A caddy device for releasable and repositionable attachment to a mounting surface which comprises:

a frame having a planar region, an attachment side and a caddy side;

caddy means attached to said frame for supporting an object;

support means attached to said frame, including a bar element extending substantially within the planar region and having a free end; and a suction cup attachment means for releasable engagement to said mounting surface, said suction cup attachment means having a mounting portion operably associated with a wall engagement portion, said mounting portion including a bore disposed in a plane substantially parallel to the plane of said wall engagement portion, and being adapted for slidable engagement with said free end of said bar element.

11. The caddy defined by claim 10, wherein said caddy means is attached rotatably to said frame.

12. The caddy defined by claim 11, wherein said caddy means is a unitary piece including a looped portion having two ends, each end being integrally connected with one bar element.

13. The caddy defined by claim 10, wherein said bar element is disposed vertically.

14. The caddy defined by claim 10, wherein said bar element is disposed horizontally.

15. The caddy defined by claim 10, wherein said caddy means includes an integral extension of said planar region.

16. A caddy device for releasable and repositionable attachment to a mounting surface which comprises:

a frame having a substantially planar region;

caddy means attached to said frame for supporting an object;

a suction cup having a wall engageable portion extending within a plane, and a mounting portion with a bore;

frame support means attached to said frame, including a bar element substantially disposed in said planar region, and being slidably received through the bore of said suction cup such that said bar element is disposed in a plane substantially parallel to the plane of said wall engageable portion; and concealing means attached to said frame to substantially cover said frame support means.

17. The caddy defined by claim 16, wherein said caddy means and said frame support means are formed together as a unitary element.

18. The caddy defined by claim 16, wherein said caddy means includes an integral extension of said substantially planar region.

19. The caddy defined by claims 16, wherein said concealing means substantially covers said bar element and the engaged suction cup.

20. A caddy device for releasable attachment to a mounting surface which comprises:

a frame having a substantially planar region defined by a first frame portion;

caddy means for supporting an object and including a second member attached to said first frame portion so as to extend orthogonally from said substantially planar region; and a support element disposed substantially within said planar region and having a free end adapted for slidable engagement with a suction cup.

21. The caddy defined by claim 20, wherein said support element is attached substantially perpendicular to said first frame portion.

22. A caddy device for releasable attachment to a mounting surface which comprises:

a frame having a planar region;

caddy means attached to said frame for supporting an object;

support means operably associated with said frame and including a linear portion having a free end disposed substantially in said planar region;

suction cup attachment means for releasable engagement to said wall surface, including a suction cup having a mounting portion adapted to receive said free end of said linear portion; and frame stabilizing means for contacting said mounting surface so that said planar region of said frame is substantially parallel to said mounting surface.

* * * * *